United States Patent [19]

Binder et al.

[11] Patent Number: 4,873,937

[45] Date of Patent: Oct. 17, 1989

[54] METHOD AND APPARATUS FOR SPRAYING POWDER INTO A CONTINUOUS TOW

[75] Inventors: John J. Binder, Lorain; Thomas A. Kaiser, Vermilion, both of Ohio

[73] Assignee: Nordson Corporation, Westlake, Ohio

[21] Appl. No.: 149,539

[22] Filed: Jan. 28, 1988

[51] Int. Cl.[4] ..... B05B 15/12

[52] U.S. Cl. ..... 118/44; 118/308; 118/325; 118/326; 156/180; 156/283

[58] Field of Search ..... 118/308, 325, 326, 44; 156/180, 283

[56] References Cited

U.S. PATENT DOCUMENTS

| | | | |
|---|---|---|---|
| 1,103,947 | 7/1914 | Destrez | 118/308 |
| 2,966,198 | 12/1960 | Wylde | 118/325 |
| 3,042,567 | 7/1962 | King | 239/291 |
| 3,189,506 | 6/1965 | Cobb et al. | 156/180 |
| 3,384,507 | 5/1968 | Godwin et al. | 118/325 |
| 3,439,649 | 4/1969 | Probst et al. | 118/312 |
| 3,589,333 | 6/1971 | Quackenbush | 118/308 X |
| 3,603,287 | 9/1971 | Christy et al. | 118/312 |
| 3,703,396 | 11/1972 | Lamanche et al. | 156/180 |
| 3,746,254 | 7/1973 | Duncan et al. | 239/15 |
| 3,830,638 | 8/1974 | Jumentier et al. | 118/308 X |
| 3,978,695 | 9/1976 | Hurzeler et al. | 118/325 X |
| 4,014,286 | 3/1977 | De Zurik | 118/312 |
| 4,024,815 | 5/1977 | Platsch | 118/312 |
| 4,044,175 | 8/1977 | Coxon et al. | 118/312 |
| 4,260,265 | 4/1981 | Faverty et al. | 427/180 X |
| 4,263,871 | 4/1981 | Gibson | 118/312 |
| 4,273,597 | 6/1981 | Garner et al. | 118/44 |
| 4,274,512 | 6/1981 | Goelz | 188/65.1 |
| 4,317,425 | 5/1982 | Greve et al. | 118/325 |
| 4,369,549 | 1/1983 | Sanders | 19/105 |
| 4,372,994 | 2/1983 | Haig | 118/312 |
| 4,412,505 | 11/1983 | Hausler et al. | 118/325 |
| 4,421,055 | 12/1983 | Arthur et al. | 118/325 |
| 4,435,239 | 3/1984 | Harris | 156/180 |
| 4,476,807 | 10/1984 | Pryor | 118/325 X |
| 4,600,603 | 7/1986 | Mulder | 118/308 |

FOREIGN PATENT DOCUMENTS

86/00019 7/1986 PCT Int'l Appl. .

*Primary Examiner*—Shrive Beck

*Attorney, Agent, or Firm*—Wood, Herron & Evans

[57] ABSTRACT

A method and apparatus for spraying particulate powder material into a continuous roving or tow formed of individual strands comprises a hollow spraying chamber having inlet and outlet guides for receiving the tow moving axially therethrough. A stream of air-entrained particulate powder material is injected into the hollow spraying chamber, at an angle relative to the direction of movement of the tow, with a velocity such that the individual strands of the tow are separated from one another and the particulate powder material is lodged between the exterior surfaces of adjacent strands throughout substantially the entire thickness of the tow.

8 Claims, 2 Drawing Sheets

METHOD AND APPARATUS FOR SPRAYING POWDER INTO A CONTINUOUS TOW

FIELD OF THE INVENTION

This invention relates to apparatus for spraying particulate powder material, and, more particularly, to an apparatus for spraying particulate powder material into a continuous roving of tow formed of individual fibrous strands.

BACKGROUND OF THE INVENTION

The use of a continuous roving or tow in the formation of such articles as filters is well known. A tow comprises a plurality of individual strands, often formed of a non-woven, fibrous material, which are packed together in an elongated bundle. The individual strands may extend continuously along the entire length of the tow, or may be a few inches in length in which case they are arranged end-to-end within the tow.

In the fabrication of filters, for example, it is desirable to coat the individual strands forming the tow with a material which improves the filtration properties of the strands, and/or with a material which adheres the individual strands together within the tow. In prior art systems such as disclosed, for example, in U.S. Pat. Nos. 4,317,425 to Greve et al and No. 4,421,055 to Arthur et al, coating material has been applied by axially moving the tow past one or more fixed spraying devices positioned within a chamber having a recovery system for collecting oversprayed coating material. These spraying devices comprise rotating brushes whose bristles pick up the coating material from a reservoir or supply roller, and then project the coating material in fine droplets onto the moving tow.

The problem with this prior art method has been that the coating material is often not applied to each of the individual strands within the tow. Depending upon the density or tightness with which the individual strands in the tow are packed, the coating material applied in the manner described above may not penetrate into the interior of the tow and cover the outer surface of each of the strands. As a result, only the exterior surface of the tow, or some of the individual strands immediately beneath the outer surface of the tow, are covered with the coating material. The filtration properties of such tows are therefore limited.

In order to more completely coat each of the individual strands within a tow, efforts have been made in the prior art to separate the individual strands in the tow before the coating material is applied. One apparatus of this general type is disclosed, for example, in U.S. Pat. No. 2,966,198 to Wylde. In the Wylde patent, the tow is advanced through a chamber in which a pressurized stream of air creates a turbulence to separate the individual strands of the tow. A liquid coating material is thereafter applied to the individual strands from a tube located within the interior of the chamber which has a discharge orifice positioned downstream from the point at which the pressurized air is applied to the tow.

A problem with the apparatus disclosed in Wylde, and similar apparatus, is that the tube which ejects the coating material is located within the interior of the coating chamber and the tow must pass over and around the tube as it moves through the coating chamber. This could result in damage to the tow, particularly where the individual strands thereof are relatively densely packed.

SUMMARY OF THE INVENTION

It is therefore among the objectives of this invention to provide a method and apparatus for covering a tow with a coating material which does not damage the tow and which ensures substantially complete coverage of the outer surface of the individual strands of the tow with coating material.

These objectives are accomplished in an apparatus which comprises a hollow spraying chamber through which a tow of individual strands is axially movable between an inlet guide connected at one end of the chamber and an outlet guide connected at the opposite end of the chamber. In one embodiment, the guides are fixed to the spraying chamber; alternatively, the spraying chamber is formed with sleeves which slidably receive guides having an outer wall carrying O-rings adapted to seal against the facing inner wall of the sleeves. The chamber is formed with a vent on one side and an inlet port opposite the vent which is connected to a device for spraying a coating material, preferably air-entrained particulate powder coating material. The spraying device is effective to eject the air-entrained particulate powder material into the tow in a direction substantially perpendicular to the direction of the movement of the tow, such that the individual strands of the tow are separated from one another and the particulate powder material becomes lodged between the outer surfaces of adjacent strands throughout substantially the entire diameter or thickness of the tow.

In the presently preferred embodiment, the diameter of the spraying chamber, and the diameter of outlet guide, are chosen to restrict the "expanded" diameter of the tow, i.e., the diameter or largest transverse dimension of the tow when the individual fibers are separated from one another upon impact by the air-entrained particulate powder stream. With the spraying chamber and outlet guide so dimensioned, the particulate powder material entrained in the stream of air sprayed into the chamber is confined such that the powder material is directed through the tow instead of around its outer circumference.

The spraying device of this invention is of the type disclosed in U.S. Pat. No. 4,600,603 which is owned by the assignee of this invention. Another aspect of this invention involves operating such spray gun, and the source of coating material which supplies the spray gun, at pressure levels which ensure that the air-entrained particulate powder stream has sufficient velocity to adequately separate the individual strands of the tow from one another and sufficient quantities of particulate powder material to substantially cover the outer circumference of the strands. The velocity of the air-entrained particulate powder stream is chosen to accommodate a number of variables for a given application including the density with which the individual strands are packed within the tow, the diameter or largest transverse dimension of the tow, the tension exerted on the tow as it is moved axially through the spraying chamber, the axial speed of the tow through the spraying chamber, the type of material forming the strands of the tow, the size and shape of the particulate powder material coating, the quantity of particulate powder material to be applied to the tow and other factors.

For example, it may be necessary to increase the velocity of the air-entrained particulate powder stream separate the individual strands in a relatively densely packed tow or wherein substantial tension applied to the tow as it is advanced through spraying chamber. On the other hand, the velocity of the air-entrained particulate powder material might be reduced for tows having relatively loose individual strands, tows of relatively small diameter and tows moving through the spraying chamber at a relatively slow rate.

In one presently preferred embodiment, a phenolic resin in particulate form was sprayed into a chamber having a diameter of approximately one inch at a velocity in the range of about 7,000 to 9,600 feet per minute (fpm). The tow moving through the chamber comprised a polyester fiber material approximately 0.625 inches in diameter having individual fibers approximately two to three inches in length and 25 to 30 microns in diameter. At a tow velocity of approximately 100 feet per minute, the individual strands in the tow were successfully separated from one another, and their outer surface substantially covered with the phenolic resin, such that the weight of the tow after coating increased by an amount in the range of 25 to 30%.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
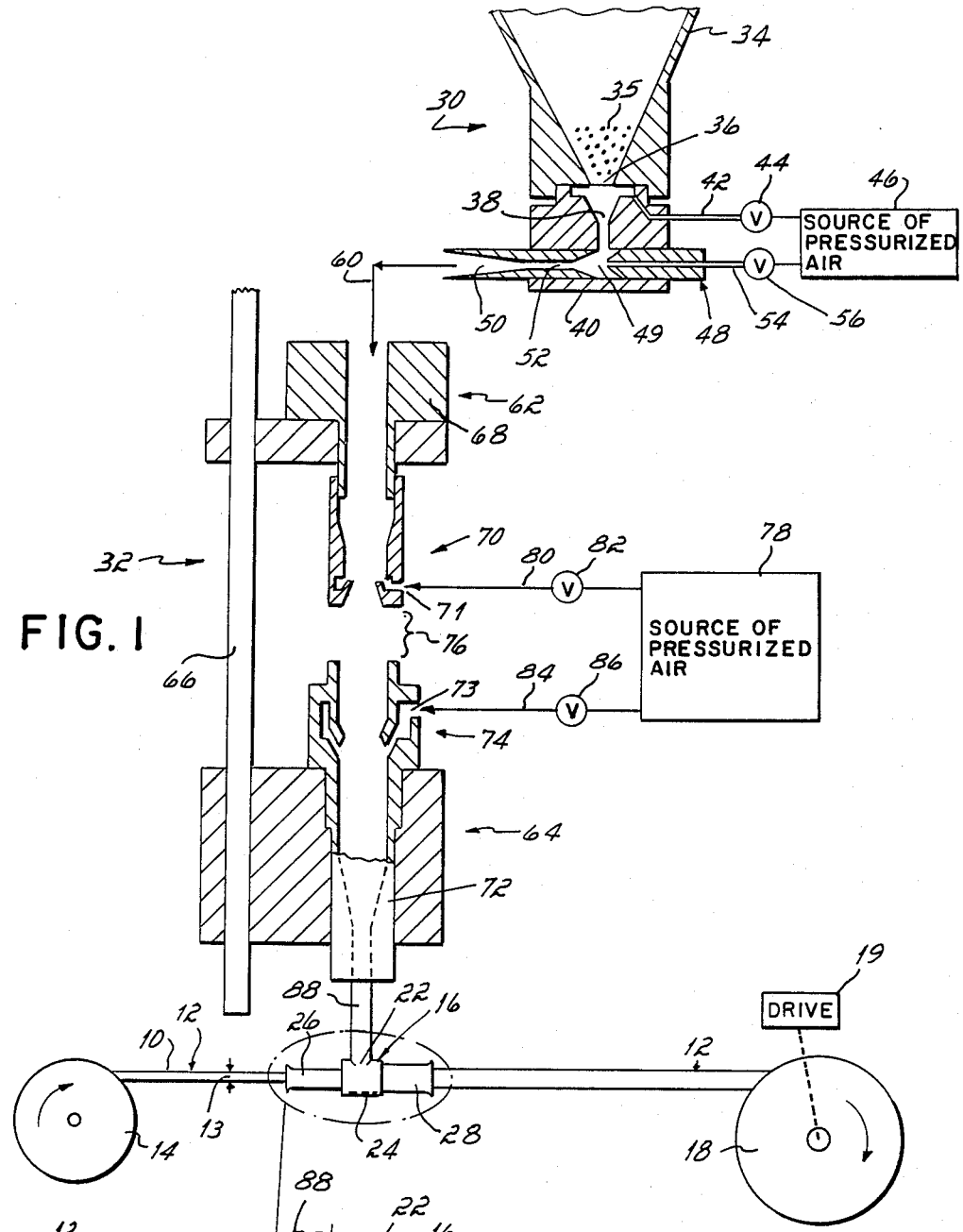
FIG. 1 is an overall schematic view, in partial cross section, of the apparatus herein for coating the individual strands of a tow with particulate powder material.

Referring now to FIG. 1, an apparatus is illustrated for spraying air-entrained particulate powder material onto the individual strands 10 of a roving or tow 12 having a diameter or thickness 13. The tow 12 originates from a box or a reel 14, a carding machine, spinneret or other tow generating device. The tow 12 is drawn axially from the reel 14 through; a spraying chamber 16 discussed below, and then is collected on a winder 18 rotated by a drive 19 shown schematically in FIG. 1. The individual strands 10 forming the tow 12 each extend along the length of the tow, or, alternatively, are a few inches in length, and are packed together in a desired density. Such strands 10 may be formed of a non-woven, fibrous material or the like. The fabrication of tow 12 forms no part of this invention per se and is thus not discussed in detail herein.

Figure 2:
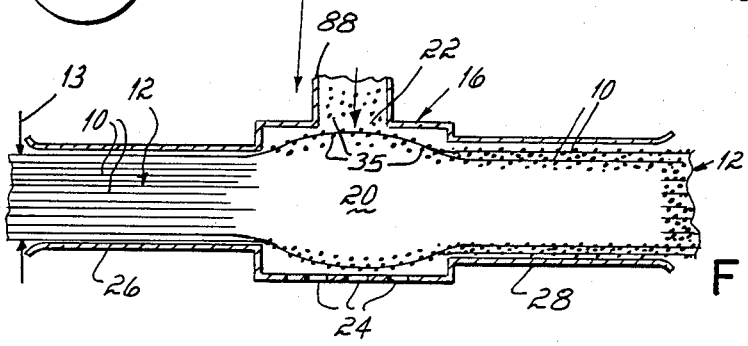
FIG. 2 is an enlarged conceptual schematic view of the encircled area shown in FIG. 1 which is greatly increased in scale for purposes of illustration.

The spraying chamber 16 has a hollow interior 20, a powder inlet 22 and a vent 24 which is spaced approximately 180° from powder inlet 22. In the embodiment of FIGS. 1 and 2, a hollow, cylindrical-shaped inlet guide 26 is fixedly mounted at one end of the spraying chamber 16, and a hollow cylindrical outlet guide 28 is fixedly mounted on the opposite end of the spraying chamber 16 in axial alignment with the inlet guide 26.

Figure 3:
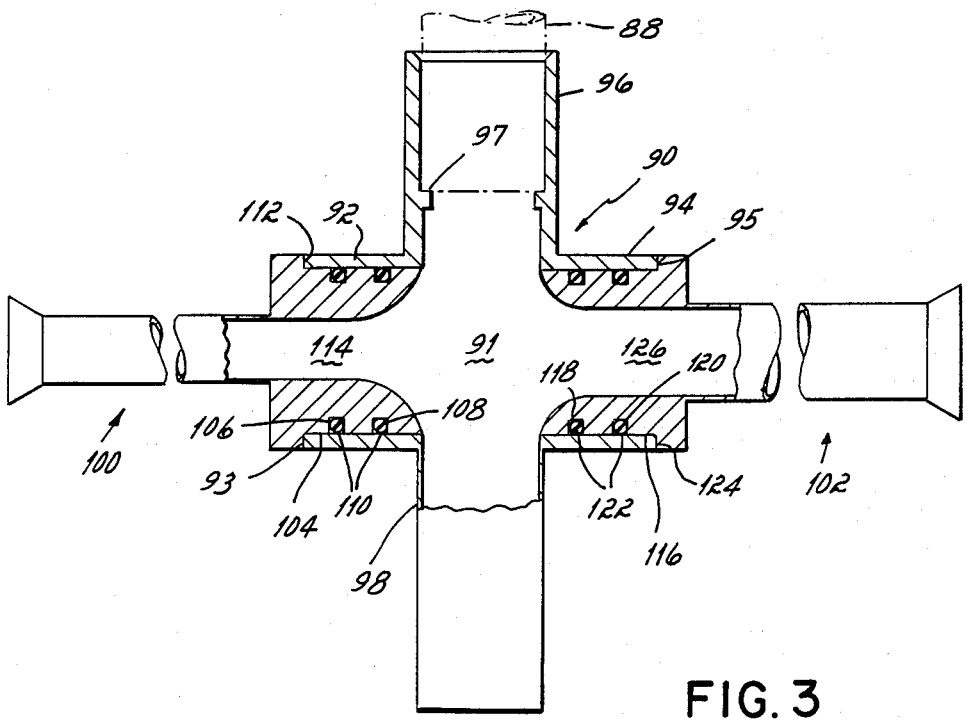
FIG. 3 is an enlarged view of the spraying chamber in partial cross section illustrating an alternative embodiment of mounting the guides to the spraying chamber.

Alternatively, as viewed in FIG. 3, a spraying chamber 90 is provided having opposed, axially aligned sleeves 92, 94, a powder inlet 96 formed with an internal shoulder 97 and a vent or return line 98. An inlet guide 100 is insertable within the sleeve 92, an outlet guide 102 is insertable within the sleeve 94, and the powder inlet 96 receives the nozzle 88 of spray gun 32 which seats against the shoulder 97 formed therein.

The inlet guide 100 includes an inner end having an outer wall 104 formed with spaced grooves 106, 108, each of which mounts an O-ring 110. An annular shoulder 112 is formed in the inlet guide 100 outwardly from the grooves 106, 108 which seats against the outer edge 93 of sleeve 92 with the inlet guide 100 inserted completely into the sleeve 92. The inlet guide 100 is also formed with a central passageway 114 having a diameter less than that of either the spray chamber 90 or outlet guide 102 but about equal to the diameter or thickness 13 of tow 12.

Similarly, the outlet guide 102 includes an inner end having an outer wall 116 formed with spaced grooves 118, 120 which mount O-rings 122. An annular shoulder 124 formed on outlet guide 102 seats against the outer edge 95 of sleeve 94 with the outlet guide 102 inserted completely therein. The outlet guide 102 has a central passageway 126 for receiving the tow 12 after it passes through spraying chamber 90, as described below. Both the inlet and outlet guides 102, 104 are therefore removably mounted to the spraying chamber 90 and are sealed thereto to prevent leakage.

In the presently preferred embodiment, particulate powder material is supplied into either the spraying chamber 16 or spraying chamber 90 from a powder source 30 connected to a powder spray gun 32. The powder source 30 is of the type disclosed in detail in U.S. Pat. No. 3,746,254 to Duncan et al, the disclosure of which is incorporated by reference in its entirety herein. Briefly, for purposes of the present discussion, the powder source 30 comprises a hopper 34 filled with particulate powder material 35 having an outlet 36 connected to a passageway 38 formed in a metering block 40. A metering or powder flow rate line 42 carrying a valve 44 is connected at one end to the outlet 36 and at the other end to source 46 of pressurized air. An outlet tube 48 is mounted within the metering block 40 which is formed with a chamber 49 connected to the passageway 38. The outlet tube 48 has an axial passageway 50 formed with a venturi 52 located downstream from chamber 49. An air fluidizing line 54 having a valve 56 is connected at one end to the chamber 49, upstream from passageway 38, and at the other end to the source 46 of pressurized air.

In operation, pressurized air from the source 46 is delivered through the metering or powder flow rate line 42 to the outlet 36 of hopper 34. The valve 44 mounted in the flow rate line 42 controls the pressure of the air delivered to the outlet 36 of hopper 34 and thus the quantity of particulate powder material deposited into passageway 38. Particulate powder material flows in a stream through the passageway 38 into the chamber 49 within the outlet tube 48. This stream of particulate powder material is impacted by pressurized air flowing through the air fluidizing line 54 at a velocity controlled by the pressure setting of valve 56. The particulate powder material is thus entrained within the stream of air from the fluidizing line 54 and is accelerated through the venturi 52 and out the axial passageway 50 into a transfer line 60 connected to the powder spray gun 32.

The powder spray gun 32 may be of essentially any suitable design such as shown, for example, in U.S. Pat. No. 4,600,603 to Mulder, the disclosure of which is incorporated by reference in its entirety herein. The powder spray gun 32 forms no part of this invention per se and is thus only briefly described. The powder spray gun 32 comprises a powder introduction head 62 connected to the transfer line 60 and a powder spray barrel 64 located downstream from the head 62. Both the powder introduction head 62 and barrel 64 are supported from a common post 66.

The powder introduction head 62 comprises a body 68 on the lower end of which there is mounted an inverted air flow amplifier 70. The barrel 64 comprises a generally tubular sleeve 72 and an air flow amplifier 74 mounted atop that sleeve 72. The outlet of the air flow amplifier 70 and the inlet of the air flow amplifier 74 are spaced apart by an air gap 76 so that ambient or room air is free to enter both amplifiers 70, 74 and supplement the air within which powder is entrained in the course of passage through the spray gun 32.

The air flow amplifier 70 is connected to a source of pressurized air 78 by a suspension air line 80 having a valve 82. Compressed air entering the inlet 71 of air flow amplifier 70 from suspension air line 80 is directed in an upstream direction relative to the downstream flow of particulate powder material injected into the spray gun 32 from the transfer line 60. This high pressure, high velocity air flow within air flow amplifier 70 functions to draw ambient or room air into the air amplifier 70 through air gap 76 and create a homogeneous air and powder mixture internally of the air amplifier 70.

The inlet 73 of air flow amplifier 74 is connected to the air source 78 by a pattern air line 84 having a valve 86 therein. Compressed air flowing through the pattern air line 84 into the air flow amplifier 74 is directed in a downstream direction therefrom which pulls ambient air through the air gap 76 and thus draws the air-powder mixture from the air flow amplifier 70 downwardly into the barrel 64. The air-entrained particulate powder material is accelerated by the air flow amplifier 74 through the powder spray barrel 64 and out the tubular sleeve 72 which is connected by a nozzle 88 to the powder inlet 22 of spraying chamber 16 or powder inlet 96 of spraying chamber 90.

The method of operation of the spraying device of this invention is as follows. In the embodiment of FIGS. 1 and 2, the tow 12 of individual elongated strands 10 is unwrapped from the reel 14, inserted through the inlet guide 26 into the interior 20 of spraying chamber 16 where particulate powder material is injected into the tow 12 and then passes through the outlet guide 28 to a winder 18. The winder 18 is rotated by drive 19 and is operable to pull the tow 12 at a constant feed rate axially through the center of the guides 26, 28 and the spraying chamber 16. After the tow 12 is collected on the winder 18, it is heated by an oven or the like to melt the particulate powder material 35 so that it adheres to the strands 10 of the tow 12.

In the course of passage of the tow 12 through the spraying chamber 16, the powder spray gun 32 is operable to impact the tow 12 with a stream of air-entrained particulate powder material 35 which is preferably sprayed substantially perpendicularly to the direction of axial movement of the tow 12 through the chamber 16. The velocity of the air-entrained particulate powder material ejected from the powder spray gun 32, controlled primarily by the pressure setting of valve 86 within the pattern air line 84, is chosen to separate the individual strands 10 from one another within the tow 12. The individual strands 10 forming tow 12 are aerated, i.e., physically moved apart from one another within the spraying chamber 16, allowing the particulate powder material 35 to pass the interior of the tow 12 and lodge between the exterior surfaces of adjacent strands 10 within the tow 12. This ensures coverage of powder material 35 along the exterior surfaces of the strands 10 throughout substantially the entire diameter or thickness 13 of the tow 10. Oversprayed powder material is collected through the vent 24 for reuse.

In the presently preferred embodiment, the internal diameter or transverse internal dimension of the inlet and outlet guides 26, 28 and the internal diameter or transverse internal dimension of spraying chamber 16 are chosen to ensure substantially complete coverage of the exterior surfaces of the strands 10 within the tow 12. Preferably, the diameter of inlet guide 26 is approximately equal to the initial diameter of the tow 12. The diameter of the spraying chamber 16 is somewhat larger than that of the inlet guide 26 and initial diameter or thickness 13 of the tow 12 to permit controlled expansion of the tow 12 upon impact with the air-entrained particulate powder material ejected from spray gun 32. This "controlled expansion" of the tow 12 within chamber 16 permits separation of the individual strands 10 from one another, but contains the strands 10 within a confined space within the interior of the chamber 16. As a result, the particulate powder material 35 is forced through the tow 12 and in between adjacent strands 10 within the interior thereof instead of being allowed to flow around the exterior surface of the tow 12 which could occur if a space or gap was formed between the inner wall of the chamber 16 and the outer surface of tow 12.

Once particulate powder material 35 has been sprayed into the tow 12, the tow 12 exits the spraying chamber 16 through the outlet guide 28 for storage on winder 18. Preferably, the diameter of outlet guide 28 is smaller than that of the spraying chamber 16 but larger than the initial diameter or thickness 13 of tow 12. After being sprayed with the particulate powder material 35, the tow 12 is thus compressed to some extent as it exits the spraying chamber 16 through outlet guide 28 to eliminate or reduce air contained therein. The final diameter of the tow 12 is thus greater than its initial diameter or thickness 13.

The method of operation described above for the apparatus of FIGS. 1 and 2 is essentially identical to that for the apparatus of FIG. 3. The tow 12 is moved through inlet guide 100 into the interior 91 of spraying chamber 90, where strands 10 of tow 12 are substantially covered with particulate powder material 35, and then out through the outlet guide 102. The primary difference between the apparatus of FIGS. 1 and 2, and that of FIG. 3, is that the outlet guides 100, 102 are removable and can be easily replaced with other outlet guides having passageways of different diameter to accommodate different sized tows 12.

As mentioned above, the method of this invention is directed to impacting the axially moving tow 12 with a stream of air-entrained particulate powder material 35 directed substantially perpendicularly to the direction of movement of the tow 12 such that the individual strands 10 of the tow 12 are separated from one another to receive the particulate powder material 35. The velocity of the stream of air-entrained particulate powder material 35 must be controlled according to the parameters of the system and physical characteristics of the tow 12 and particulate powder material 35. For example, the density at which the strands 10 of tow 12 are packed together and the diameter of the tow 12 may vary considerably, and the velocity of the stream of air-entrained particulate powder material 35 must be adjusted to separate the strands 10 of the tow 12 regardless of its density or size. Generally, densely packed strands 10 and larger diameter tows 12 require a higher velocity of the stream of particulate powder material 35 to separate the strands 10.

Parameters of the tow conveying system also affect the velocity at which the air-entrained particulate powder material 35 must be sprayed into the tow 12. For example, the tension applied to the tow 12 by the reel 14 and winder 18 is variable, and, generally, as the tension therebetween increases, the velocity of the air-entrained particulate powder material 35 must increase to separate the strands 10. Additionally, the velocity of the stream of particulate powder material must be varied as a function of the velocity or residence time of the tow 12 within the spraying chamber 16.

In addition, the density and other physical properties of the powder material, as well as the quantity of particulate powder material 35 to be sprayed into the tow 12, can also have an impact upon the velocity of the stream of air-entrained particulate powder material 35.

It is contemplated that the velocity at which the powder spray gun 30 ejects particulate powder material 35 into the spraying chamber 16 can be readily adjusted with minimal experimentation for a variety of tows 12, for different system operating conditions and for different types of particulate powder materials.

For example, the following test conditions were employed in practicing the method of this invention:

| | |
|---|---|
| Tow Parameters: | |
| Fiber length | 2–3 inches |
| Fiber diameter | 25–30 microns |
| Tow length | 100 feet |
| Tow diameter | .625 inches |
| Tow velocity | 100 feet/minute |
| Powder Parameters: | |
| Powder type | 29–302 phenolic resin manufactured BTL Company |
| Particle size | 75–100 microns |
| Particle shape | irregular |
| Particle cure time and temperature | 380° F. for 3 hours |
| Air Pressure Settings: | |
| Air flow rate line (54) | 20 psi |
| Air fluidizing line (50) | 30 psi |
| Suspension air line (80) | 20 psi |
| Spraying Chamber and Guides: | |
| Inlet guide diameter | .625 inches |
| Spraying chamber diameter | 1.000 inches |
| Outlet guide diameter | .750 inches |

Given the above-identified parameters, the pressure of the compressed air within pattern air line 84 was varied from about 15 to 25 psi which produced a stream of air-entrained particulate powder material 35 ejected from the powder spray nozzle 88 into the spraying chamber 16 at a velocity in the range of about 7,000 to 9,600 feet per minute. It was observed that the stream of air-entrained particulate powder material 35 entering the spraying chamber 16 at that range of velocities successfully separated the individual strands 10 within the tow 12, and the powder material 35 became lodged between the exterior surfaces of adjacent strands 10 throughout the tow 12, such that the weight of the tow 12 exiting spraying chamber 16 was increased by approximately 25 to 30%. See FIG. 2. In the course of passage through spraying chamber 16, the diameter of the tow 12 increased to about the diameter of the chamber 16 to permit separation of the strands 10, and the tow 12 was then compressed in the smaller diameter outlet guide 28 to a final diameter of about 0.750 inches.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, although the powder inlet 22 to spraying chamber 16 is illustrated in the Figs. as being oriented substantially perpendicularly relative to the longitudinal axis of the spraying chamber 16, it is contemplated that the powder inlet 22 could be angled up to about 45° relative to the longitudinal axis of chamber 16 such that powder is ejected therefrom in the direction of movement of tow 12.

Therefore, it is intended that the invention not be limited to the particular embodiment disclosed as the best mode contemplated for carrying out this invention, but that the invention will include all embodiments falling within the scope of the appended claims.

We claim:

1. Apparatus for spraying particulate powder material into an axially moving tow formed of individual strands, comprising:

a spraying chamber having a hollow interior with a longitudinal axis, said spraying chamber being formed with a powder inlet port and a vent;

a hollow inlet guide and a hollow outlet guide each connected to said spraying chambered communicating with said hollow interior thereof, said hollow inlet guide being adapted to receive a tow which is axially movable through said spraying chamber and out said hollow outlet guide;

a powder spray device mounted to said powder inlet port of said spraying chamber, said power spray device having a discharge outlet which is oriented at an angle relative to said longitudinal axis of said spraying chamber and which is located on one side of said tow movable axially through said spraying chamber, said powder spray device being effective to spray a stream of air-entrained particulate powder material through said powder inlet port into said hollow interior of said spraying chamber at a velocity such that individual strands of the tow are separated from one another with said spraying chamber and the particulate powder material is lodged between the exterior surface of adjacent strands throughout substantially the entire thickness of the tow.

2. The apparatus of claim 1 in which said hollow interior of said spraying chamber and said hollow interior of said hollow outlet guide each have a transverse internal dimension, said transverse internal dimension of said hollow outlet guide being less than said than said transverse internal dimension of said spraying chamber, said tow being compressed and the diameter thereof reduced in moving from said spraying chamber through said hollow outlet guide.

3. The apparatus of claim 2 in which said hollow inlet guide has a transverse internal dimension less than said transverse internal dimensions of said spraying chamber and said hollow outlet guide but slightly greater than the transverse dimension of said tow.

4. The apparatus of claim 1 in which said spraying chamber is formed with a vent for the escape of over-sprayed particulate powder material from said spraying chamber.

5. The apparatus of claim 1 in which said velocity of said stream of air-entrained particulate powder material ejected into said spraying chamber is in the range of about 7,000 to 9,600 feet per minute.

6. Apparatus for spraying particulate powder material into an axially moving tow formed of individual strands, comprising:

a spraying chamber having a hollow interior, said spraying chamber being formed with a first sleeve, a second sleeve, a powder inlet port and a vent all communicating with said hollow interior, said first sleeve and said second sleeve each having a wall forming a passageway;

a hollow inlet guide removably connected to said first sleeve of said spraying chamber, said hollow inlet guide having means for forming a seal against said wall of said first sleeve;

a hollow outlet guide removably connected to said second sleeve of said spraying chamber in axial alignment with said hollow inlet guide, said hollow outlet guide having means for forming a seal against said wall of said first sleeve;

said hollow inlet guide, said spraying chamber and said hollow outlet guide receiving a tow which is axially movable in a first direction through said hollow inlet guide into said hollow interior of said spraying chamber along the longitudinal axis thereof and out said outlet guide;

a powder spray device mounted to said powder inlet port of said spraying chamber at an angle relative to said longitudinal axis of said spraying chamber, said powder spray device being effective to spray a stream of air-entrained particulate powder material into said hollow interior of said spraying chamber at a velocity such that the individual strands of the tow are separated from one another within said spraying chamber and the particulate powder material is lodged between the exterior surfaces of adjacent strands throughout substantially the entire thickness of the tow.

7. The apparatus of claim 6 in which said hollow inlet guide has a wall formed with at least one groove which mounts an O-ring seal, said hollow inlet guide being insertable into said passageway formed by said wall of said first sleeve so that said O-ring seal engages and seals against the inner surface of said wall of said first sleeve.

8. The apparatus of claim 7 in which said hollow outlet guide has a wall formed with at least one groove which mounts an O-ring seal, said hollow outlet guide being insertable into said passageway formed by said wall of said second sleeve so that said O-ring seal engages and seals against the inner surface of said wall of said second sleeve.

* * * * *

UNITED STATES PATENT AND TRADEMARK OFFICE

CERTIFICATE OF CORRECTION

PATENT NO. : 4,873,937

DATED : October 17, 1989

INVENTOR(S) : John J. Binder et al

It is certified that error appears in the above-identified patent and that said Letters Patent is hereby corrected as shown below:

Column 3, line 6, "loose" should be --loosely packed--.

Column 8, line 38, "chambered" should be --chamber and--.

Column 8, line 41, after "said", please insert --hollow inlet guide into said hollow interior of said--.

Column 8, line 44, "power" should be --powder--.

Signed and Sealed this

Fifth Day of October, 1993

Bruce Lehman

*Attest:*

BRUCE LEHMAN

*Attesting Officer*

*Commissioner of Patents and Trademarks*